United States Patent [19]

Holmes et al.

[11] 4,451,028

[45] May 29, 1984

[54] SHEET FEEDING APPARATUS

[75] Inventors: Maurice F. Holmes, Rochester; Gerald M. Garavuso, Macedon, both of N.Y.

[73] Assignee: Xerox Corporation, Stamford, Conn.

[21] Appl. No.: 325,159

[22] Filed: Nov. 27, 1981

[51] Int. Cl.[3] ..... B65H 3/14

[52] U.S. Cl. ..... 271/11; 271/30 R; 271/34; 271/93; 271/94; 271/98; 271/108; 271/110

[58] Field of Search ..... 271/11, 93, 98, 105, 271/108, 110–112, 258, 259, 34, 94, 30 R

[56] References Cited

U.S. PATENT DOCUMENTS

| | | | |
|---|---|---|---|
| 2,086,577 | 7/1937 | Reinartz | 271/93 X |
| 2,895,552 | 7/1959 | Pomper et al. | 164/68 |
| 2,979,329 | 4/1961 | Cunningham | 271/29 |
| 3,391,926 | 7/1968 | Jaatinen | 271/112 |
| 3,424,453 | 1/1969 | Halbert | 271/35 |
| 3,947,016 | 3/1976 | Horung | 271/111 X |
| 4,157,177 | 6/1979 | Strecker | 271/197 |
| 4,268,025 | 5/1981 | Murayoshi | 271/112 |
| 4,324,395 | 4/1982 | Silverberg | 271/98 |
| 4,382,593 | 5/1983 | Beran | 271/93 X |

FOREIGN PATENT DOCUMENTS

| | | | |
|---|---|---|---|
| 2029375 | 3/1980 | United Kingdom | 271/93 |

*Primary Examiner*—Richard A. Schacher

[57] ABSTRACT

A sheet feeding apparatus with a sheet support tray, a rear vacuum plenum chamber adapted to acquire the rear portion of a sheet, a front vacuum plenum chamber positioned over the front of the sheet and adapted to acquire the front portion of a sheet, sheet transport means associated with the front vacuum plenum to transport a sheet acquired in a forward direction and an air knife positioned at the rear of the stack of sheets to inject air between the trailing edge of the top sheet in a stack and the remainder of the stack. In a specific embodiment the trail edge of a sheet in a stack is separated by the air knife, acquired by the rear vacuum plenum then acquired by the front vacuum plenum and transported in a forward direction. As the trailing edge clears the rear vacuum, the rear vacuum which together with the air knife is continuously activated, acquires the next sheet in the stack. In this way the speed of the sheet feeder can be very high since sheets are separated and acquired by the feeder simultaneously with transporting them off the stack. Preferably the air knife includes preacquisition fluffer jets to initially loosen the top few sheets in the stack and lateral converging air streams to facilitate separation of the topmost sheet in the stack.

27 Claims, 14 Drawing Figures

(PLAN VIEW)

(SIDE VIEW)

SHEET FEEDING APPARATUS

BACKGROUND OF THE INVENTION

The present invention relates to sheet feeding apparatus and in particular to high speed sheet separating and feeding apparatus. A specific embodiment is directed to a top vacuum corrugating feeding apparatus with two vacuum plenums, one for top sheet acquisition and the other for top sheet transport.

With the advent of high speed xerographic copy reproduction machines wherein copies can be produced at a rate in excess of several thousand copies per hour, the need for a sheet feeder to feed cut copy sheets to the machine in a rapid, dependable manner was recognized to enable full utilization of the reproduction machine's potential copy output. In particular for many purely duplicating operations, it is desired to feed cut copy sheets at very high speeds where multiple copies are made of an original placed on the copying platen. In addition, for many high speed copying operations, a document handler to feed documents from a stack to a copy platen of the machine in a rapid dependable manner has also been reorganized to enable full utilization of the machine's potential copy output. These sheet feeders must operate flawlessly to virtually eliminate the risk of damaging the sheets and generate minimum machine shutdowns due to uncorrectable misfeeds or sheet multifeeds. It is in the initial separation of the individual sheets from the sheet stack where the greatest number of problems occur.

Since the sheets must be handled gently but positively to assure separation without damage through a number of cycles, a number of separators have been suggested such as friction rolls or belts used for fairly positive document feeding in conjunction with a retard belt, pad, or roll to prevent multifeeds. Vacuum separators such as sniffer tubes, rocker type vacuum rolls, or vacuum feed belts have also been utilized.

While the friction roll-retard systems are very positive, the action of the retard member, if it acts upon the printed face can cause smearing or partial erasure of the printed material on the document. With single sided documents if the image is against the retard mechanism, it can be smeared or erased. On the other hand, if the image is against the feed belt it smears through ink transfer and offset back to the paper. However, with documents printed on both sides the problem is compounded. Additionally, the reliable operation of friction retard feeders is highly dependent on the relative frictional properties of the paper being handled. This cannot be controlled in a document feeder.

One of the sheet feeders best known for high speed operation is the top vacuum corrugated feeder with front air knife. In this system, a vacuum plenum with a plurality of friction belts arranged to run over the vacuum plenum is placed at the top of a stack of sheets in a supply tray. At the front of the stack, an air knife is used to inject air into the stack to separate the top sheet from the remainder of the stack. In operation air is injected by the air knife toward the stack to separate the top sheet, the vacuum pulls the separated sheet up and acquires it. Following acquisition, the belt transport drives the sheet forward off the stack of sheets. In this configuration, separation of the next sheet cannot take place until the top sheet has cleared the stack. In addition, acquisition of the next sheet in the stack cannot occur until the top sheet has cleared the vacuum plenum. In this type of feeding system every operation takes place in succession or serially and therefore the feeding of subsequent sheets cannot be started until the feeding of the previous sheet has been completed. This procedure takes time and therefore limits the potential operational speed of the sheet feeder. In such a system in order to try to increase the through put speed, it has been proposed to activate the vacuum and the transport belts continuously. This frequently results in a difficulty in acquiring the top sheet in a stack since it must be acquired by a vacuum over which friction belts are moving. In addition, the second sheet can be prematurely acquired as the trail edge partially clears the vacuum plenum. An overlay multifeed may occur that must be separated with another device. Thus the inherent structure in such a system limits its potential operational speed. In addition, in this type of system the air knife may cause the second sheet to vibrate independent of the rest of the stack in a manner referred to as "flutter". When the second sheet is in this situation, if it touches the top sheet, it may tend to creep forward slightly with the top sheet. The air knife then may drive the second sheet against the first sheet causing a shingle or double feeding of sheets.

PRIOR ART

U.S. Pat. No. 2,979,329 (Cunningham) describes a sheet feeding mechanism useful for both top and bottom feeding of sheets wherein an oscillating vacuum chamber is used to acquire and transport a sheet to be fed. In addition an air blast is directed to the leading edge of a stack of sheets from which the sheet is to be separted and fed to assist in separating the sheets from the stack.

U.S. Pat. No. 3,424,453 (Halbert) illustrates a vacuum sheet separator feeder with an air knife wherein a plurality of feed belts with holes are transported about a vacuum plenum and pressurized air is delivered to the leading edge of the stack of sheets. This is a bottom sheet feeder.

U.S. Pat. No. 2,895,552 (Pomper et al) illustrates a vacuum belt transport and stacking device wherein sheets which have been cut from a web are transported from the sheet supply to a sheet stacking tray. Flexible belts perforated at intervals are used to pick up the leading edge of the sheet and release the sheet over the pile for stacking.

U.S. Pat. No. 4,157,177 (Strecker) illustrates another sheet stacker wherein a first belt conveyor delivers sheets in a shingled fashion and the lower reach of a second perforated belt conveyor which is above the top of the stacking magazine attracts the leading edge of the sheets. The device has a slide which limits the effect of perforations depending on the size of the shingled sheet.

U.S. Pat. No. 4,268,025 (Murayoshi) describes a top sheet feeding apparatus wherein a sheet tray has a vacuum plate above the tray which has a suction hole in its bottom portion. A feed roll in the suction hole transports a sheet to a separating roll and a frictional member in contact with the separating roll.

SUMMARY OF THE INVENTION

It is an object of the present invention to provide an improved sheet separator feeder.

It is an additional object of the present invention to provide an improved high speed sheet separator feeder.

It is an additional object of the present invention to provide a more efficient and more reliable high speed sheet separator feeder.

It is an additional object of the present invention to provide a sheet feeder which simultaneously separates and acquires the topmost sheet of a stack while feeding the previous sheet from the stack.

It is a further object of the present invention to provide a sheet feeder which separates and acquires sheets in parallel with transporting of sheets.

It is an additional object of the present invention to reduce the amount of second sheet flutter and thereby the occurrence of multifeed failures.

These and other objects are attained with a sheet feeding apparatus comprising a sheet stack support tray, a rear vacuum plenum chamber positioned over the rear portion of the sheet stack support tray, and adapted to acquire the rear portion of a sheet when sheets are placed in the tray, a front vacuum plenum chamber positioned over the front of said sheet stack support tray and adapted to acquire the front portion of a sheet when sheets are in the tray, sheet transport means associated with said front vacuum plenum to transport the sheets acquired by said front vacuum plenum in a forward direction out of the sheet stack support tray, and an air knife means positioned at the rear of said sheet stack support tray adapted to inject air between the trailing edge of the top sheet in a stack of sheets and the remainder of the stack with a stack of sheets in the tray. Means are provided to activate the front and the rear plenums and the front transport means such that as the front transport means transports the topmost sheet in a stack of sheets when sheets are in the sheet stack tray, and when the trailing edge of the topmost sheet clears the rear plenum, the rear plenum acquires the rear of the next sheet in the stack to prepare it for forward feeding. In a specific aspect of the present invention, a sheet feeder simultaneously separates and acquires the topmost sheet of a stack while feeding the previous sheet from the stack.

In a further specific aspect of the present invention, both the front and the rear vacuum plenums have members positioned under their bottom center to provide a center corrugation parallel to the sheet feeding direction, and the sheet transport comprises a belt transport system wherein a plurality of belts are disposed about the front vacuum plenum. In another aspect of the present invention, the air injection means includes means to inject the substantially planar stream of air between the top sheet and the remainder of the stack. The planar stream of air having portions at its sides which converge toward the center of the planar air stream, thereby providing both convergence in the planar stream and expansion in the direction perpendicular to that of the air stream to facilitate separation of the sheet to be separated from the remainder of the stack.

For a better understanding of the invention as well as other objects and further features thereof, reference is made to the following drawings and descriptions.

DESCRIPTION OF THE PREFERRED EMBODIMENT

The invention will now be described with reference to a preferred embodiment of the high speed sheet feeding apparatus. As used herein the term "high speed sheet feeding" is intended to mean the feeding of sheets at a speed greater than one per second. Typically apparatus according to the present invention is capable of feeding sheets in excess of four sheets per second and has achieved sheet feeding rates as high as seven and seven tenth sheets ($8\frac{1}{2}'' \times 14''$, long edge feed) per second.

Figure 1:
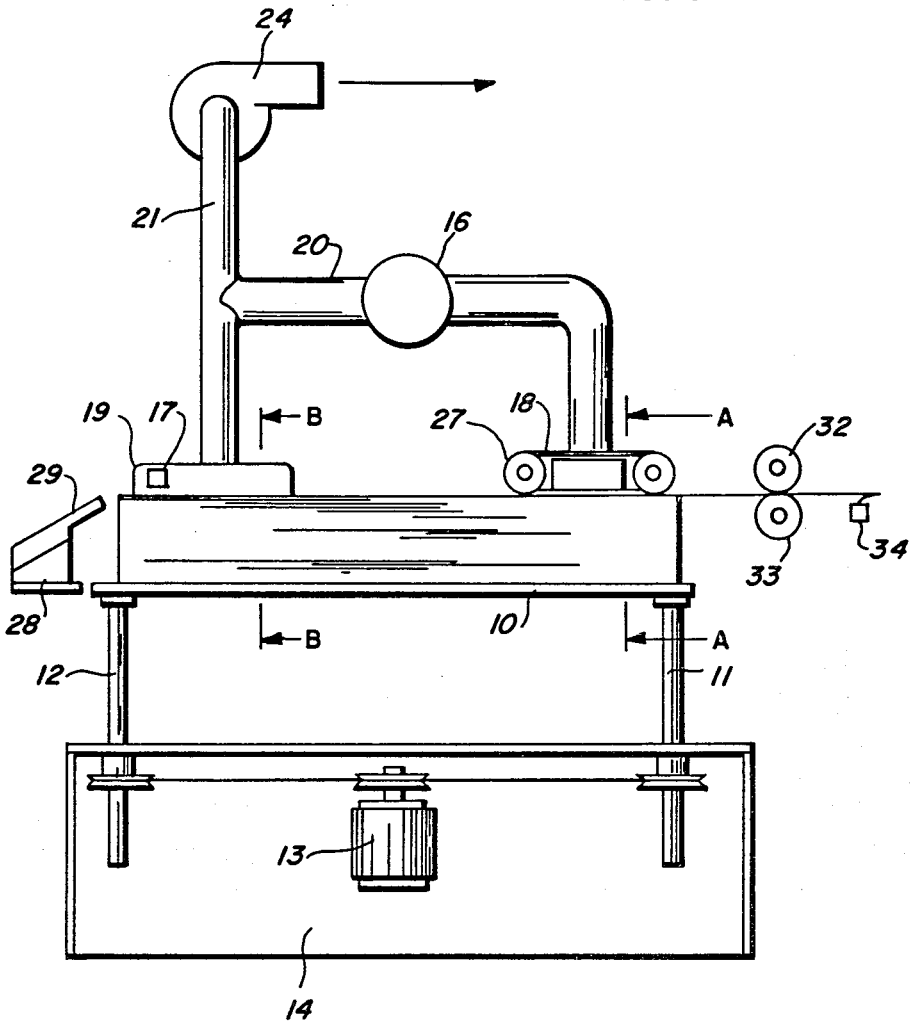
FIG. 1 is a cross sectional side view of an exemplary sheet feeder employing the present invention.

Referring more particularly to FIG. 1, there is illustrated an exemplary sheet separator feeder for installation adjacent to the exposure platen of a conventional xerographic reproduction machine for feeding of documents to the platen for copying. Alternatively or in addition, the sheet feeder may be mounted at the beginning of the paper path for the feeding of cut sheets of paper. In either situation, the feeder illustrated is merely one example of a sheet separation feeder which may be used according to the present invention. The sheet feeder is provided with a sheet stack supporting tray 10 which may be raised and lowered through electric power screws 11, 12 by means of motor 13 from the base support platform 14. The drive motor is activated to move the sheet stack support tray vertically upward by stack height sensor 17 when the level of sheets relative to the sensor falls below a first predetermined level. The drive motor is inactivated by the stack height sensor 17 when the level of the sheets relative to the sensor is above a predetermined level. The stack height sensor is located at the rear and at a side of the stack of paper to sense height level. In this way the level of the top sheet in the stack of sheets may be maintained within relatively narrow limits to assure proper sheet separation, acquisition and feeding. The illustrated device provides both a front and a rear vacuum plenum arrangement to perform separate functions in the steps of sheet acquisition and transport. The front vacuum plenum 18 and the rear vacuum plenum 19 are supplied with low air pressure source through conduits 20, 21 by means of vacuum pump 24. When the pump 24 is activated air is pulled from both the front and rear vacuum plenums through the pump to exhaust 25. A valve 16, which will be discussed in greater detail later, is placed in the air conduit 20 supplying the front vacuum plenum. The front vacuum plenum also has associated with it a belt transport assembly, which will also be described in detail later, for transporting the top sheet in the stack from the stack.

At the rear of the stack of sheets is an air injection means or air knife 28 having at least one nozzle 29 directed to the rear or trailing edge of the top sheet in a stack of sheets to be fed. The air knife serves to direct a continuous blast of air at the trailing edge of a sheet to separate the top sheet from the remainder of the stack by inserting a volume of air therebetween. In this embodiment, the air knife performs two functions, preacquisition separation of sheets and if necessary a port acquisition separation of the top sheet from the remainder of the stack.

In operation, the sheet stack support tray 10 is elevated by power screws 11, 12 and advances the topmost sheet to the sheet feeding level. The vacuum pump 24 is activated and continuously exhausts air from lines 21 and 20, it being noted that line 20 is periodically closed by valve 16. In addition the air knife is continuously activated to inject air between the top sheet and the remainder of the stack and serves to separate the top sheet from the remainder of the stack. Once separated, the trailing portion of the top sheet is readily acquired by the rear vacuum plenum 19. With the valve 16 open, the front of the topmost sheet is acquired by the front plenum 18 as the air knife 28 continues to direct air into the space formed between the top sheet and the remainder of the stack, and forces a separation of the top sheet from the remainder of the stack. The belt transport assembly is activated and the top sheet which has been acquired by both vacuum plenums, is driven forward from the stack. The sheet is fed forward since the driving force on the sheet from the belt transport and front plenum assembly is greater than the drag force exerted on the sheet by the rear plenum. For both plenum chambers the force exerted F is controlled by the pressure applied, times the area of the sheet exposed to the vacuum, times the coefficient of friction. Since the pressure applied may be the same in both plenum chambers, it does not have to be the controlling factor. The area of exposure and the coefficient of friction, with reference to the rear plenum, are relatively low and hence the drag force is also relatively low. In contrast, the belt assembly associated with the front plenum provides a relatively large area of contact with the top sheet and has a surface with a relatively high coefficient of friction. Thus, the frictional driving force exerted on the sheet by the front vacuum and by the belt transport assembly is greater than the drag force exerted on the sheet by the rear vacuum plenum.

Typically in operation, the air knife 28 and the rear vacuum plenum 19 are constantly actuated while the front vacuum plenum 18 and belt transport 27 are pulsed for each sheet that is fed to insure an intercopy gap between the sheets being fed and to avoid the possibility of sheets shingling out with the top sheet and giving rise to shingle sheet feeding or multisheet feeding. Generally the belt transport and the front vacuum plenum are pulsed simultaneously to start and stop the vacuum and the belt drive. Alternatively the belt transport assembly may be continuously driven while the front vacuum plenum is pulsed on and off for each sheet feed. This is a possible alternative because if the vacuum in the front plenum is turned off the transport belt may continue to advance the top sheet since its leading edge may have already been captured by the output feed roll 32 which will deliver the top sheet from the tray. Output feed roll pair 32 is in driving engagement with output idler roll pair 33 to continuously drive separated sheets onto the next operating station in the process. At the nip of the output feed roll pair is a sensor 34 for sensing the leading edge of a sheet. This sensor, by its location, automatically determines that a sheet has been separated and fed and is under a different drive system. Accordingly, the front vacuum plenum 18 and the belt transport 27 may be inactivated. Typically the vacuum is turned off first since it takes some time for the vacuum to dissipate before the belt transport is inactivated. Furthermore, if precise registration is desired from the sheet feeder, it may be desirable to have a time delay between vacuum activation and belt transport to achieve the desired registration.

Figure 2A:
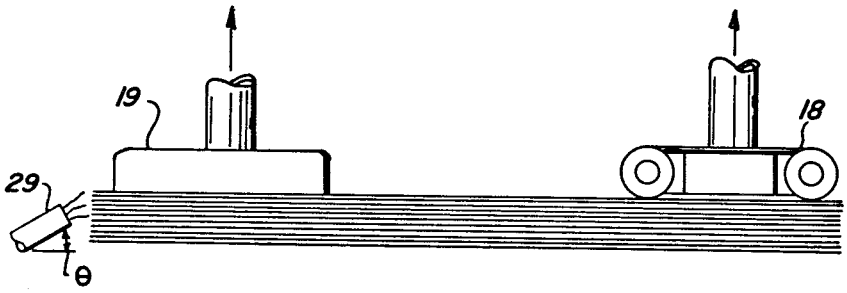
FIGS. 2A and 2B are enlarged cross sectional side views of an exemplary sheet feeder showing the parallel sheet acquisition and feeding of successive sheets which is obtainable according to the present invention.
Figure 2B:
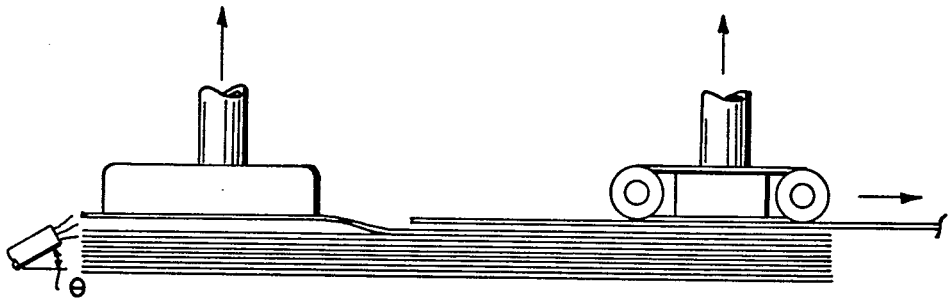

Reference to FIGS. 2A and 2B will schematically illustrate the time saving achieved with the apparatus according to the present invention. In FIG. 2A, the top sheet is shown as being acquired by both the rear and the front vacuum plenums. In FIG. 2B, the belt transport has been activated and the top sheet has been fed forward a short distance. Simultaneously with the top sheet being fed forward a short distance over the stack of sheets, the rear vacuum plenum and air knife cooperate to separate the second or next sheet from the remainder of the stack and acquire the rear portion of the second or next sheet. As the top sheet continues to feed out, the second sheet is more fully captured by the rear vacuum plenum. When the lead edge of the top sheet reaches the output feed roll sensor, the front vacuum plenum and belt arrangement is pulsed providing a small intercopy gap between successive sheets after which the front vacuum plenum and the belt transport are activated to acquire the sheet as shown in FIG. 2A. Thus, these two illustrations show the savings in time that may be realized with the present invention, since the sheet separation and acquisition function is separated from the sheet transport function, and the two functions may be carried out simultaneously rather than serially as in the prior art. Furthermore, with the separation of the functions, greater control is possible over each of them and there is greater flexibility to maintain control. In essence, the present invention is capable of overlaping acquisition time and transport time for different sheets.

Figure 3A:
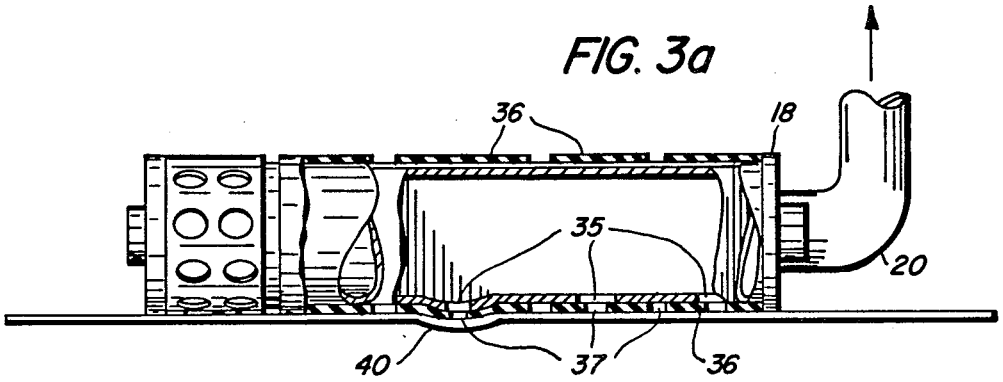
FIGS. 3A and 3B are sectional views of FIG. 1 taken along the lines AA and BB respectively of FIG. 1 and show the sheet corrugating members in both of the vacuum plenums.
Figure 3B:
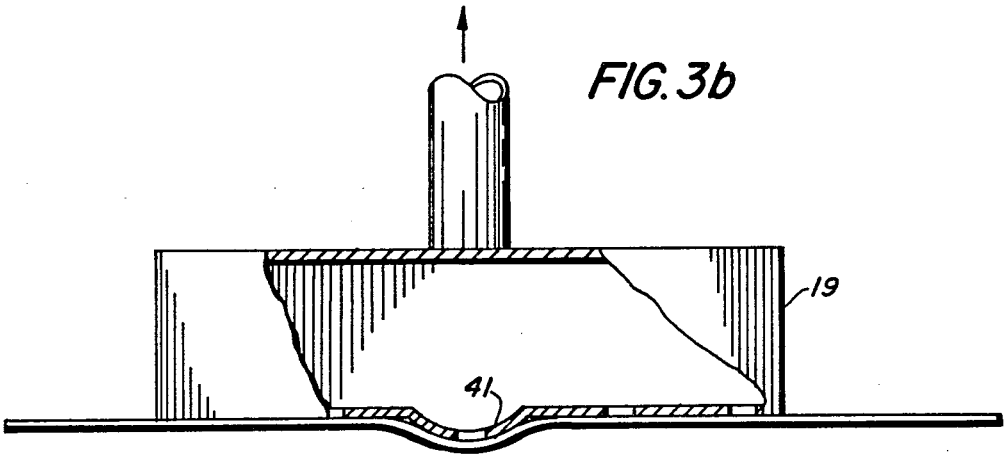

With reference to FIGS. 3A and 3B, the sheet corrugating means will be described in greater detail. In each instance, a center corrugating member is placed in the sheet path to corrugate the sheet in a double valley configuration which tends to give a structural integrity as the sheet is moved in a controlled transport from station to station. It is particularly effective in stiffening lightweight papers for controlled transport. In addition with a corrugation in the direction of sheet travel, it is unlikely that the lead edge of the sheet will curl up or down since most curl is perpendicular to the feed direction and a very large force would be required to overcome the beam strength of the sheet in a direction perpendicular to the corrugating direction. A further principle function of corrugation is to facilitate separation of tenacious or sticky interfaces of successive sheets. This is achieved partcularly in the event when two sheets are completely acquired by the vacuum plenum, the top sheet conforms to the corrugation. The next adjacent sheet cannot completely conform to the corrugation since the pressure drop across the second sheet is less than that across the first and is not great enought to deform the sheet sufficiently. This condition normally leaves small openings or pockets between the top sheet and the next adjacent sheet in the vicinity of the corrugation. Once an opening occurs, the air knife flow fills these pockets, pressuring the interface until the pocket spreads throughout the entire interface. In FIG. 3A the cross section of the front vacuum plenum 18 shows a number of plenum apertures 35 open at the bottom of the plenum to a plurality of transport belts 36, each of which has a plurality of perforations 37 (see FIG. 5) in communication with the apertures over which the belts travel. The corrugating member 40 is in the center of the run of belts and runs parallel to the belt transport direction and forms a double valley configuration in the sheet. The rear corrugating system is shown in FIG. 3B and simply comprises a small roll or bar 41 depressed slightly below the two ends of the rear vacuum plenum 19 to also provide a double valley configuration for an acquired sheet.

Figure 4:
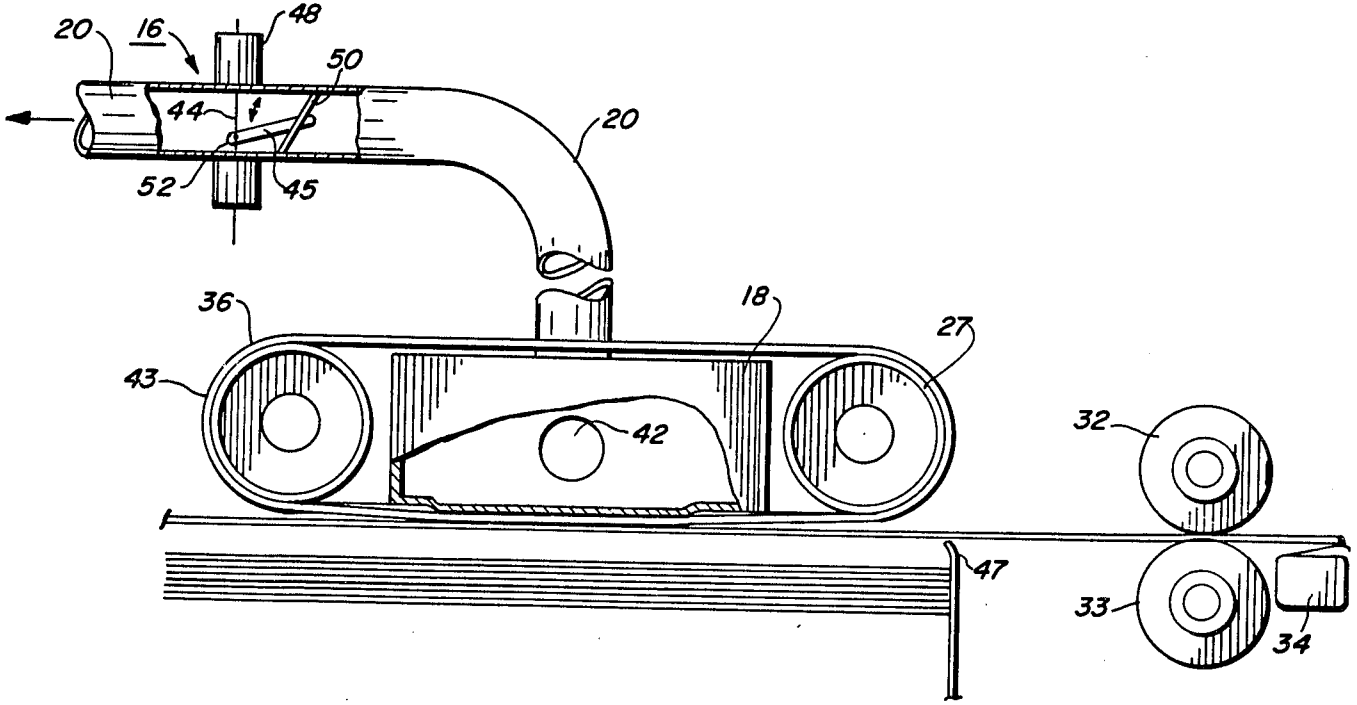
FIG. 4 is an enlarged view of the front plenum of FIG. 1 showing the plenum valve actuation in greater detail.
Figure 5:
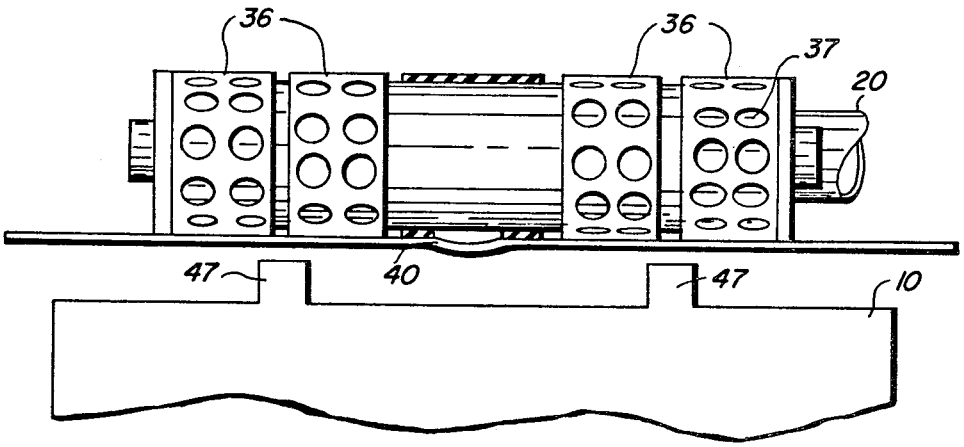
FIG. 5 is a front view of the belt transport assembly and sheet stacking tray with a sheet being transported.

With continued reference to FIG. 3A and additional reference to FIGS. 4 and 5, the belt transport assembly 27 will be described in greater detail. A plurality of belts 36 are driven in a counterclockwise direction about transport drive rolls 43 and 44 by suitable means not shown. Each of the belts (five are illustrated in FIG. 3A) has a plurality of holes or perforations 37 in the surface which are in open communication with the front plenum apertures 35. It is through these apertures with the flow of air into the vacuum plenum that the sheets are attracted and acquired by the belt. The center belt passes over a corrugating member 40 to provide a double valley corrugation in the sheet. The sheet retaining fingers 47 (See FIG. 5) at the front edge of the sheet stacking tray 10, serve to block any forward movement of sheets prior to their front portions being acquired by front vacuum plenum 18. The air injected between the top sheet and the remainder of the sheets in the stack by the rear air knife or the fluffer jets may otherwise blow the second sheet off the stack and forward off the sheet stack tray. This is particularly true for the lightweight sheets and where the second sheet is being stripped from the first sheet. The presence of the sheet retaining fingers 47 thereby minimizes the possibility of sheets shingling out of the sheet stacking tray. The vacuum port 42 shown in FIG. 4, provides the vacuum in the plenum chamber 18 and is connected to the pump through conduit 20.

With continued reference to FIG. 4, the operation of the valve 16 will be described in greater detail. As described previously, in operation the rear vacuum plenum and the air knife are activated continuously while the front vacuum plenum and the belt transport are pulsed for every sheet fed to provide an intercopy gap and insure there is no sheet shingling or multifeed. The valve 16 which is a conventional butterfly valve is the means by which the vacuum is introduced and dissipated in the front vacuum plenum 18. When a vacuum is to be introduced, the butterfly valve 16 is positively driven open by solenoid 48 so that the valve plate 50 is open, permitting complete communication between the two parts of conduit 20 separated by the valve. With solenoid 41 off, the solenoid 48 pulls arm 44 which is connected to crank 45 up thereby pivoting the valve plate about the pivot pin 46 to the open position. When the vacuum is to be eliminated, the solenoid 48 is turned off, solenoid 41 is turned on and valve plate 50 is pulled to the closed position by solenoid 41 through the bar 52, which pulls the crank 45 down thereby pivoting the valve plate 50 about the pivot pin 46 to the desired position. In an alternative embodiment, solenoid 48 is on continuously urging the valve plate 50 to the open position and solenoid 41, which has a greater pulling power through solenoid 48 is activated pulling arm 52 down and through crank 45 closing the valve. To open the valve solenoid 41 is merely inactivated, solenoid 48 still being activated, pulls the arm 44 up and through crank 45 pivots the valve plate 50 about pivot pin 46 to the open position. The valve is positively driven to both the open and closed position in order to speed up the total operation of the feeder and thereby the feeding throughout. There is a finite time in any case for opening and closing the valve even when positively driven which readily provides the necessary time to create the intercopy gap. Typically it takes sixty milliseconds to open and another sixty milliseconds to close the valve.

Figure 6:
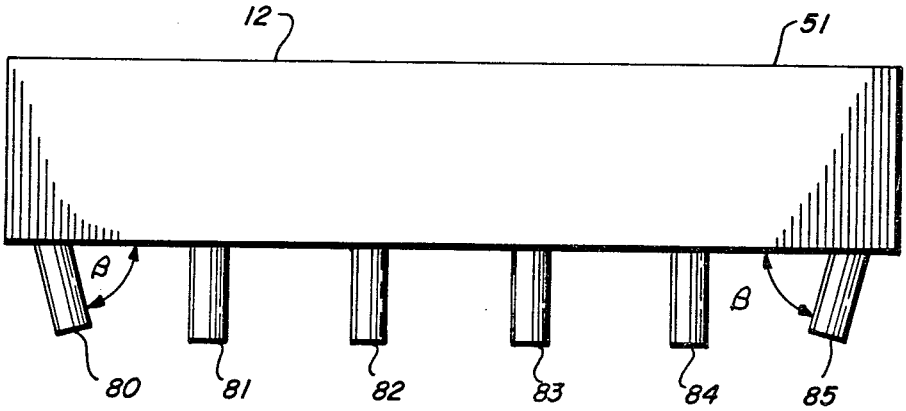
FIG. 6 is a plan view illustrating the lateral converging air knife useful in the present invention.
Figure 7A:
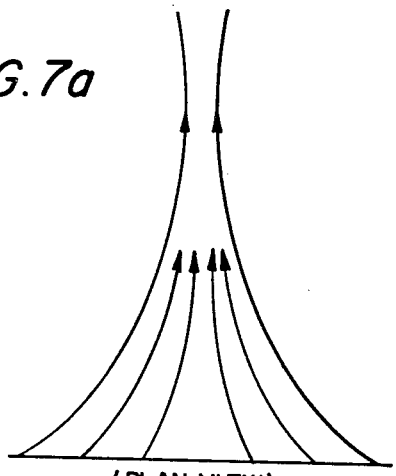
FIGS. 7A and 7B are plan and side view illustrations of the air converging stream (FIG. 7A) and expanding air streams (FIG. 7B).
Figure 7B:
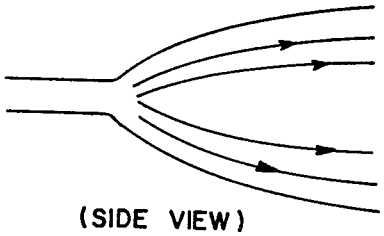
Figure 8:
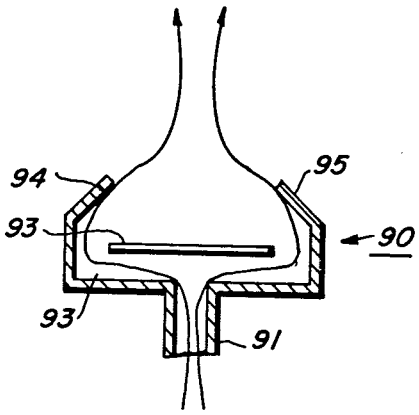
FIG. 8 is a plan view of an alternative embodiment of the lateral converging air knife.
Figure 9:
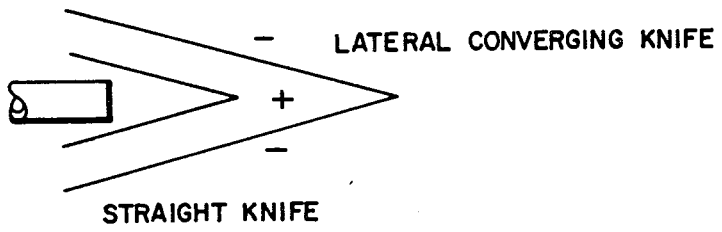
FIG. 9 is a plan view illustrating an exemplary comparison of the area of maximum pressure achieved with a conventional air knife and one with the lateral converging air knife.
Figure 10:
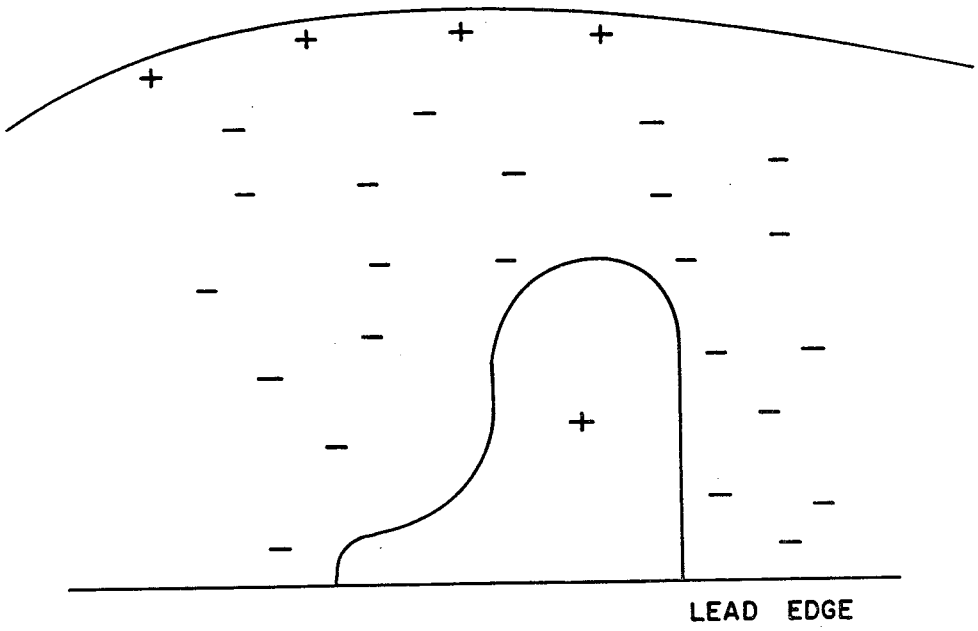
FIG. 10 is an illustration of an exemplary pressure pattern showing the positive pressure footprint which is achieved with the lateral converging air knife.

With reference to FIGS. 6–10, the air injection apparatus or air knife 28 will be described in greater detail. The air injection apparatus or air knife injects an air stream at any suitable angle to the plane of the stack of sheets to separate the top sheet from the remainder of the stack. Typically the air knife is upwardly inclined toward the rear edge of a stack of sheets and is at an angle $\theta$ of from about 40° to about 80° relative to the plane of the stack of sheets to be separated and fed. FIG. 6 illustrates a pressurized air plenum 51 having an array of separated air nozzles 80–85 inclusive. The middle four nozzles 81–84 direct the air stream toward the center of the parallel air streams and provide converging stream of air. Typically the end nozzles are angled inwardly at an angle $\beta$ of from about 20° to about 50° to the direction of the main air stream. Particularly effective separating of the sheet to be fed from the remainder of the stack is achieved when the outermost nozzles are at an angle of about 30°. The nozzles 80–85 are all arranged in a plane so that the air stream which emerges from the nozzles is essentially planar. As the stream produced from nozzles 80 and 85 goes out from the end of the nozzles they tend to converge laterally and drive the other air streams toward the center of the stream. What is believed to be happening in this procedure may be more graphically illustrated with reference to FIG. 7 wherein the plan view, 7A, shows the generally converging nature of the air stream path at the ends or sides of the air stream. With this contraction of the air stream in the plane of the original air stream there is believed to be an expansion in the direction perpendicular to the air stream. Stated in another manner, while the air stream converges essentially horizontally it expands vertically which is graphically illustrated in the side view of the air stream of FIG. 7B. If the air knife is positioned such that the lateral convergence of the air stream and the vertical expansion of the air stream occurs at the center of the lead edge of a stack of sheets and particular in between the sheet to be separated and the rest of the stack, the vertical pressure between the sheet and the rest of the stack greatly facilitates separation of the sheet. In this orientation a generally planar flat jet of air is directed in between the sheet to be separated and the remainder of the stack. Once the stream has been introduced to this gap it contracts in the planar direction as a result of the end or side streams being directed inward toward a center of the air knife and therefore it must expand in the vertical direction with increased pressure both up and down. An exemplary pressure profile produced with a air knife configuration is illustrated in FIG. 10 wherein it may be seen that a thumbprint of high pressure exists in the center of the stack along the lead edge. This results in the top sheet being separated in the area where there is localized high pressure.

As the lateral stream from the end nozzles converge the projection of nozzle velocity of the air stream increases and since pressure is proportional to velocity the distance at which the dynamic or directional pressure can be applied is increased. As a result a large cone of maximum velocity or maximum potential pressure exists within the sheets in the stack. An exemplary cone for a particular configuration is graphically illustrated with reference to FIG. 9 wherein it may be seen that a much larger cone of maximum velocity and therefore pressure exists with the lateral converging knife than with the conventional straight knife with the velocity of all air streams being the same.

While the lateral converging air knife has been described with reference to individual nozzles or jets other structures and configurations may be used as long as there are two planar components which oppose one another and which are essentially perpendicular to the air stream path. In this regard attention is directed to FIG. 8 where a single nozzle 90 is illustrated. The nozzle comprises a pressurized air inlet 91, an air distribution box 92 containing a deflector plate 93 which divides the single stream of air into two paths around the deflector plate. The nozzle also includes deflecting members 94 and 95 which deflect the two air streams so that they are laterally converging.

Figure 11:
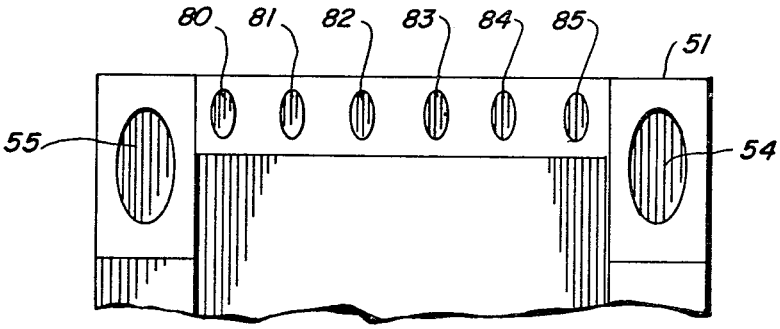
FIG. 11 is an end view of an air knife with integral fluffer jets.

A further alternative embodiment is illustrated with a front view of the air knife in FIG. 11. The nozzles 80–85 introduce pressurized air from the plenum 51 in the manner previously described. However on each side of the air knife nozzles is a large fluffer jet 54 and 55 which continuously injects air toward the top several sheets in a stack and serves to provide an initial separation, loosening or fluffing of the top several sheets in the stack prior to acquisition of the rear portion of the sheet by the rear vacuum pelnum. The initial fluffing of the top several sheets at the edges enables more effective air knife separation and the rear vacuum plenum to more effectively acquire the top sheet from the remainder of the stack. With the use of preacquisition, fluffer jets the likelihood of more than one sheet being acquired by the rear vacuum plenum is reduced. However, if two or more sheets are acquired or attempt to be acquired, the air knife pressurizes that interface and forces the unwanted sheets down to the stack. The fluffers are particularly effective in insuring adequate preacquisition separation and first acquisition of heavy weight papers. While FIG. 11 illustrates the fluffers as being integral with the air knife jets and by implication having the same pneumatic parameters as the air knife, it should be understood that the fluffer jets may be separately designed and uncoupled from the air knife.

While the invention has been principally described by reference to the preferred embodiment wherein the rear vacuum plenum and air knife with fluffers are activated continuously with the front vacuum plenum and belt transport being pulsed for each sheet feed, it should be understood that other sequencing of operations may be used. For example, the preacquisition fluffer jets may be activated first to loosen the top few sheets followed by activating the rear vacuum plenum. Furthermore in the high speed situations, both vacuum plenums and the belt transport can be activated and inactivated at the appropriate times. Alternatively, both the front and rear vacuum plenums can be activated continuously with the belt transport being turned off and on to control the sheet feeding timing. A further alternative is to continuously activate the belt transport with the front plenum being turned off and on as required. In this embodiment, the rear plenum can be continuously or cyclically activated.

The sheet separator feeder of the present invention provides a very high speed reliable sheet feeder. The speed is improved because the steps of sheet separation/acquisition are carried out simultaneously with sheet transport. Thus the time for sheet transport and sheet separation/acquistion overlaps. The prior art techniques accomplished sheet separation acquisition serially and therefore the total time involved was greater. The reliability is improved also because the functions of sheet separation acquisition have been separated from sheet transport function thereby allowing greater control over each of these separate functions and greater flexibility in how the control is maintained. Furthermore with the use of a rear lateral converging air knife the possibility of second sheet flutter and associated shingled sheet feeding is eliminated. The present invention has the simplicity of having both the front and rear vacuum plenum chambers at the same pressure rather than having to regulate pressure separately in two separate chambers.

It will be appreciated that the described device may be modified and varied by the skilled artisan upon a reading of the present disclosure. For example, while the present invention has been described with reference to a stationary feed head and an elevating sheet stacking tray, a stationary tray and moving feed head could be employed. This modification together with other modifications as may readily occur to the artisan are intended to be within the scope of the present invention.

We claim:

1. A sheet feeding apparatus comprising a sheet stack support tray, a rear vacuum plenum chamber positioned over the rear portion of said sheet stack support tray and adapted to acquire the rear portion of a sheet when sheets are in said tray, a front vacuum plenum chamber positioned over the front of said sheet stack support tray and adapted to acquire the front portion of a sheet when sheets are in said tray, said rear and front vacuum plenum chambers each having a portion positioned in its bottom center to provide a center corrugation member parallel to the sheet feeding direction, sheet transport means associated with said front vacuum plenum to transport the sheet acquired by said front vacuum plenum in a forward direction out of said sheet stack support tray, and air knife means positioned at the rear of said sheet stack support tray and adapted to inject air between the trailing edge of the top sheet in a stack of sheets and the remainder of the stack when a stack of sheets is in said tray.

2. A sheet feeding apparatus according to claim 1 wherein said sheet transport means comprises at least one transport belt having said front vacuum plenum disposed within the run of said at least one transport belt.

3. A sheet feeding apparatus according to claim 2 wherein said at least one transport belt comprises a plurality of vacuum feed belts having said front vacuum plenum disposed within the run of the belts, said plurality of vacuum feed belts having a plurality of perforations therein for communication with said front vacuum plenum.

4. A sheet feeding apparatus according to claim 1 including means to activate said front and rear vacuum plenum chambers and said front transport means such that as said front transport means transports the top sheet in a stack of sheets when sheets are in the sheet stack tray and when the trailing edge of said top sheet clears the rear plenum said rear plenum acquires the rear of the next sheet in the stack of sheets, whereby the top sheet is simultaneously transported in a feeding direction with the separation and acquisition of the next adjacent sheet.

5. A sheet feeding apparatus according to claim 4 including vacuum means to maintain said rear vacuum plenum and said air knife continuously activated while said front plenum and said sheet transport are activated and inactivated for each sheet feed cycle.

6. A sheet feeding apparatus according to claim 5 wherein said front and rear vacuum plenums are connected to said vacuum means and said front vacuum plenum is in vacuum communication with said rear plenum and is separated from said rear plenum by a valve means such that when said valve is open the pressure in said front and rear vacuum plenum is the same and when said valve is pulsed to the closed position the vacuum is lost in the front plenum.

7. A sheet feeding apparatus according to claim 6 including means to positively drive said valve to the open position and means to positively drive said valve to the closed position as said front plenum is pulsed between the vacuum off and vacuum on situations.

8. A sheet feeding apparatus according to claim 7 including means to simultaneously close the valve thereby cutting off the vacuum from the front plenum and inactivate the sheet transport means.

9. A sheet feeding apparatus according to claim 7 including means to initially close the valve thereby cutting off the vacuum from the front plenum and means to inactivate the sheet transport means after said valve has been closed.

10. A sheet feeding apparatus according to claim 1 including means to vertically move said sheet stack support tray upward toward said front and rear vacuum plenum such that the top sheet in a stack of sheets is maintained at about the same level, said apparatus further including a stack height sensor to activate said means to vertically move said tray when the level of sheets in said tray is below a predetermined level and means to inactivate said means to vertically move the tray when the level of a sheet in said sheet stack tray has reached a second predetermined level.

11. A sheet feeding apparatus according to claim 10 wherein said means to vertically move said sheet stack tray comprises an elevator and drive means to move said elevator in response to said stack height sensor.

12. A sheet feeding apparatus according to claim 1 including vertical finger stop means positioned at the lead edge of said sheet stack tray whereby sheets in the stack are precluded from moving in a forward direction until it is acquired by the front vacuum plenum.

13. A sheet feeding apparatus according to claim 1 including take away sheet feed means positioned at the output end of the front vacuum plenum and sheet transport.

14. A sheet feeding apparatus according to claim 13 wherein said feed means comprises at least one continuously driven feed roll in feeding engagement with at least one idler nip roll.

15. A sheet feeding apparatus according to claim 13 including means to sense the leading edge of a sheet as it enters said take away feed means and means responsive to the sensing of the leading edge of a sheet to close the vacuum valve between the front and rear vacuum plenum.

16. A sheet feeding apparatus according to claim 15 including means to inactivate the sheet transport responsive to the dissipation of the vacuum in the front vacuum plenum after the vacuum valve has been closed.

17. The sheet feeding apparatus according to claim 1 further including fluffer jets to inject air toward the top several sheets in a stack to provide an initial preacquisition loosening or separation of the top sheets in the stack each from the other prior to acquisition of the rear portion of the top sheet by the rear vacuum plenum.

18. The sheet feeding apparatus according to claim 17 wherein said fluffer jets are integral with and on each side of said air knife.

19. The sheet feeding apparatus of claim 18 wherein said fluffer jets continuously loosen the top sheets in the stack each from the other and said air knife separates the topmost sheet in the stack from the remainder of the stack.

20. The sheet feeding apparatus according to claim 1 wherein said air injection means includes means to inject a substantially planar stream of air between the top sheet and the remainder of the stack, said planar stream of air having portions at its sides which converge toward the center of the planar air stream thereby providing both convergence in the planar stream and expansion in a direction perpendicular to that of the air stream to facilitate separation of the sheet to be separated from the remainder of the stack.

21. The sheet feeding apparatus according to claim 20 wherein said air injection means comprises a single wide nozzle across a substantial portion of an edge of the sheet stacking tray, said nozzle having angular deflecting members at each end positioned to deflect the ends of the air stream in a direction to converge over the center of the sheet stacking tray.

22. The sheet feeding apparatus of claim 21 wherein said air stream is substantially horizontal and provides a greatly increased vertical pressure between the sheet to be fed and the remainder of the stack.

23. The sheet feeding apparatus of claim 21 wherein said angular deflecting members are inclined inwardly about 60° from the principal direction of the air stream.

24. The sheet feeding apparatus of claim 21 wherein said air injection means at the rear of the sheet stacking tray is upwardly inclined toward the rear edge of the stack of sheets and is at an angle of from about 40° to about 80° relative to the plane of the stack of sheets to be separated and fed.

25. The sheet feeding apparatus of claim 21 wherein said air injection means comprises an array of individual nozzles which direct air in a planar stream the end nozzles of said array being inclined in a direction to converge in the center of the air stream and over the center of the sheet stacking tray.

26. The sheet feeding apparatus of claim 25 wherein said end nozzles are inclined from about 20° to about 50° to the direction of the main air stream.

27. The sheet feeding apparatus according to claim 25 wherein said air knife includes fluffer jets on each side to inject air toward the top several sheets in a stack thereby providing an initial separation of the top several sheets, each from the other, prior to acquisition of the rear portion of the sheet by the rear vacuum plenum.

* * * * *